US006695535B1

(12) United States Patent
Lazes

(10) Patent No.: US 6,695,535 B1
(45) Date of Patent: Feb. 24, 2004

(54) FLUID COOLED HIGH TEMPERATURE RESISTANT FLOATING BARRIER

(76) Inventor: Richard J. Lazes, 804 First Ave., Harvey, LA (US) 70058

( * ) Notice: Subject to any disclaimer, the term of this patent is extended or adjusted under 35 U.S.C. 154(b) by 0 days.

(21) Appl. No.: 08/879,004

(22) Filed: Jun. 19, 1997

Related U.S. Application Data

(63) Continuation-in-part of application No. 08/851,124, filed on May 5, 1997, now abandoned, which is a continuation-in-part of application No. 08/529,010, filed on Sep. 15, 1995, now Pat. No. 5,667,337.

(51) Int. Cl.[7] ..... E02B 15/06
(52) U.S. Cl. ..... 405/63; 210/242.1; 210/923
(58) Field of Search ..... 405/60, 63–66, 405/70, 43–45, 36, 50; 210/242.1, 242.3, 923; 47/48.5

(56) References Cited

U.S. PATENT DOCUMENTS

| | | | | |
|---|---|---|---|---|
| 3,361,359 A | * | 1/1968 | Chapin | |
| 3,946,762 A | * | 3/1976 | Green | |
| 3,998,060 A | * | 12/1976 | Preus | |
| 4,065,923 A | * | 1/1978 | Preus | |
| 4,073,143 A | * | 2/1978 | Preus | |
| 4,162,863 A | * | 7/1979 | Gaudard et al. | 405/45 |
| 4,235,561 A | * | 11/1980 | Peterson | 405/45 |
| 4,537,528 A | * | 8/1985 | Simpson | 405/63 |
| 4,599,013 A | * | 7/1986 | Simpson | 405/63 |
| 4,605,586 A | * | 8/1986 | Lane | 405/63 |
| 4,619,553 A | * | 10/1986 | Fischer | 405/63 |
| 4,645,376 A | * | 2/1987 | Simpson | 405/63 |
| 4,781,493 A | * | 11/1988 | Fischer | 405/63 |
| 4,802,791 A | * | 2/1989 | FisCher et al. | 405/63 |
| 4,923,332 A | * | 5/1990 | Sanocki et al. | 405/63 |
| 4,948,295 A | * | 8/1990 | Pramsoler | 405/43 X |
| 5,152,634 A | * | 10/1992 | Maso | 405/45 |
| 5,871,305 A | * | 2/1999 | Allen | 405/70 |

* cited by examiner

*Primary Examiner*—Thomas B. Will
*Assistant Examiner*—Tara L. Mayo
(74) *Attorney, Agent, or Firm*—Warner J. Delaune

(57) ABSTRACT

A float boom for confining material floatable on a liquid surface during high temperature conditions, comprising: an elongated floatable tube formed of fluid impervious material; a source of fluid under pressure for cooling the boom during high temperature conditions; piping connected to the source of cooling fluid for distributing the cooling fluid over the length of the boom; and, a protective cover, of a fluid-absorbing material, mounted over the tube, the cover having peripheral edges adapted to engage the boom to encase the tube therein, the piping distributing the cooling fluid over the tube and under the cover to soak the cover over its length.

16 Claims, 4 Drawing Sheets

FLUID COOLED HIGH TEMPERATURE RESISTANT FLOATING BARRIER

This application is a continuation-in-part application of a previous application by the same inventor bearing U.S. Ser. No. 08/851,124 filed May 5, 1997 now abandoned, which is a continuation-in-part application of U.S. Ser. No. 08/529,010 filed Sep. 15, 1995 now U.S. Pat. No. 5,667,337. The entirety of these previous applications are incorporated herein by reference as if set forth in full below.

BACKGROUND OF THE INVENTION

1. Field of the Invention

The present invention relates to an apparatus which creates a floating boom for collecting floatable materials, such as liquid hydrocarbons, floating on the surface of a body of water. More particularly, the apparatus of the present invention is for such a floating boom that is water cooled and resistant to high temperatures or "fire proof" since in the course of containing an oil spill, the oil may be afire.

2. General Background

Some conventional "fire proof" or high temperature resistant oil booms comprise a boom encased in an insulating material and a "flame proof" cover that is high temperature resistant. Others have provided a cover blanket for conventional oil booms, the blanket being mounted onto a conventional boom thus converting it into a high temperature resistant oil containment boom.

U.S. Pat. Nos. 4,619,553 and 4,781,493 both issued to Minnesota Mining & Manufacturing Company (3M Company) on the application of E. M. Fischer and disclose a high temperature oil containment boom which allows for the in-situ burning of spilled or leaked oil during offshore oil spill cleanup, the boom having a cover blanket comprised of three layers—an outer layer of a polymer coated high temperature resistant open weave refractory fabric, a middle layer of a ceramic staple fiber refractory batt and an inner layer of a synthetic fiber, the layers being sewn together with a ceramic thread.

U.S. Pat. No. 4,537,528 issued to Shell Oil Company on the application of W. F. Simpson and discloses a "fireproof" boom having a floatation member, a skirt depending therefrom and at least two layers of heat-resistant, water-sorbent material surrounding the floatation member. The heat-resistant, water-sorbent material draws water from around the heat sensitive floatation member, forming steam in the presence of flaming pollutant and allowing only the outer layer of the heat-resistant material to become slightly singed.

U.S. Pat. No. 4,645,376 issued to Shell western E&P, Inc., on the application of W. F. Simpson and discloses a "fireproof" boom for containing flammable pollutants on water and includes a floatation member, a heat-resistant, water-sorbent material surrounding the floatation member and a protective fence surrounding the water-sorbent material. The floatation member is a series of cylindrical metal cans held end-to-end and the heat-resistant, water-sorbent material draws water around the heat-sensitive floatation member, forming steam in the presence of flaming pollutant and allowing only the outer layer of heat resistant material to become slightly singed. The protective fence surrounding the water-sorbent material is heavy steel wire woven in continuous spirals so that when the spirals are integrated with each other a diamond-shaped mesh is formed.

U.S. Pat. No. 4,605,586 issued to Globe International, Inc., on the application of P. Lane and discloses a portable fire-resistant barrier for containment of oil spills comprising a continuous length of interwoven, high-temperature resistant yarns and metallic wires, coated with a high-temperature resistant synthetic polymeric resin. The woven fabric barrier is buoyed by fire-resistant buoys and stabilized with ballast.

U.S. Pat. No. 5,374,133 issued to Oil Stop, Inc., on the application of the present applicant and others and discloses a multi-layered high temperature resistant cover installed on an inflatable boom.

U.S. Pat. No. 4,188,155 issued to P. H. Langermann and discloses a containment boom having along its length foam floats provided in pockets. Entry ports at the bottom of each pocket allow water to flow into the pockets to increase the mass of the boom to stabilize it during wave action.

U.S. Pat. No. 3,548,599 issued to W. A. Reilly and discloses a floating containment barrier that has an oil hose resting on a web between float booms, the oil hose can be coupled to a pump for pumping oil that has sloshed over the booms to drain the trough formed therebetween by the web.

U.S. Pat. Nos. 4,073,143, 4,065,923, 4,030,304, 5,522,674 and 3,998,060 all teach containment barriers that have an inner core of foam to provide flotation.

However, none of these prior devices allow for water cooling of the boom along the length of a high temperature resistant cover or blanket that has been installed thereon.

SUMMARY OF THE PRESENT INVENTION

The preferred embodiment of the apparatus of the present invention solves the aforementioned problems in a straightforward and simple manner. What is provided is an oil containment boom which can be provided with means for distributing a cooling fluid, preferably water, along the length of the boom and the high temperature resistant blanket that has been mounted on the boom.

It is a further object of the present invention to provide such a boom that can be protected from the high temperature of oil burning with such a blanket and cooling fluid distribution system.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
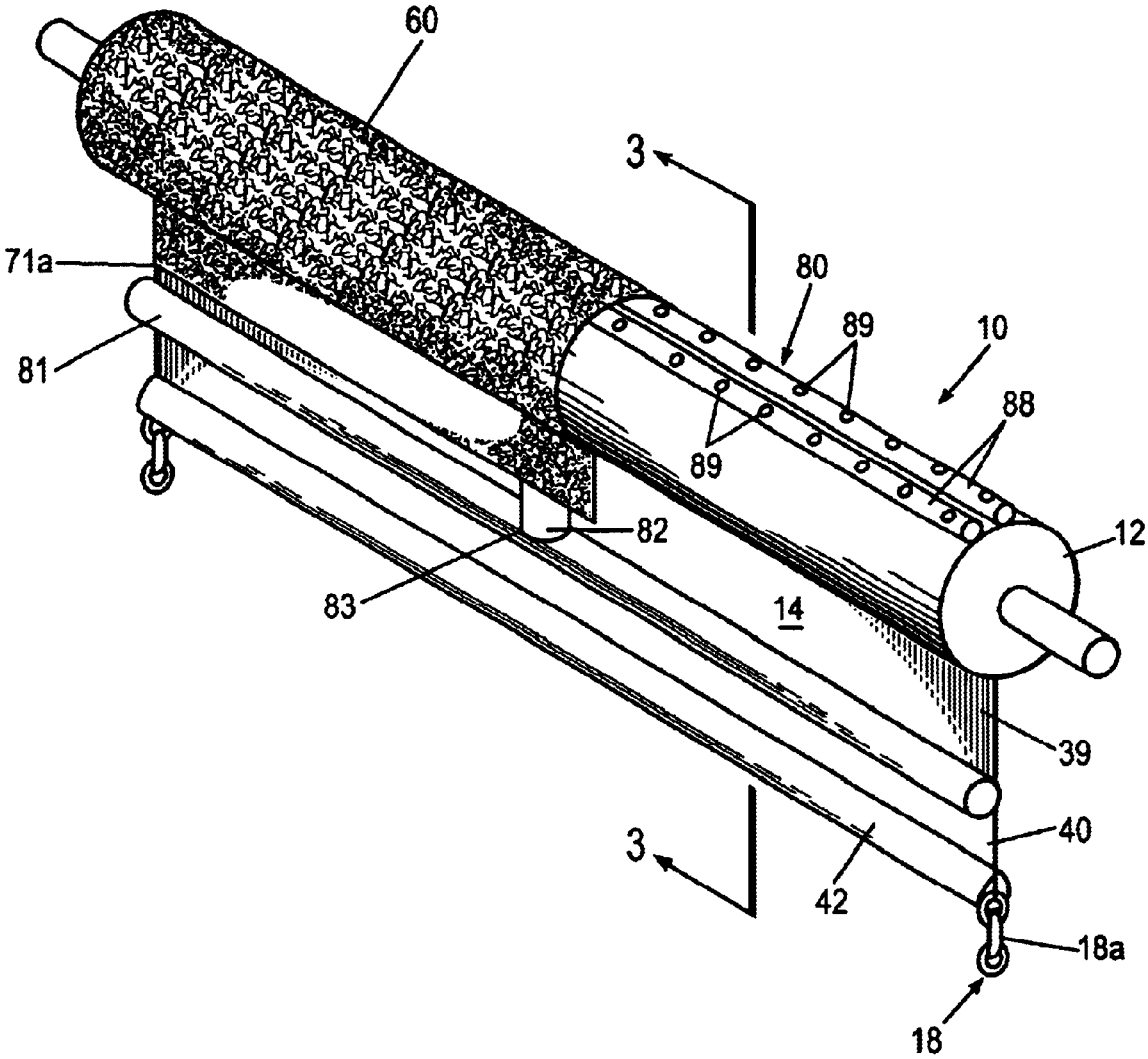
FIG. 1 is a perspective view, partially in section, of the preferred embodiment of the apparatus of the present invention, with a portion of the fluid-absorbing heat resistant barrier cut-away to illustrate a portion of the means for distributing cooling fluid over the length of the boom and heat resistant barrier.
Figure 2:
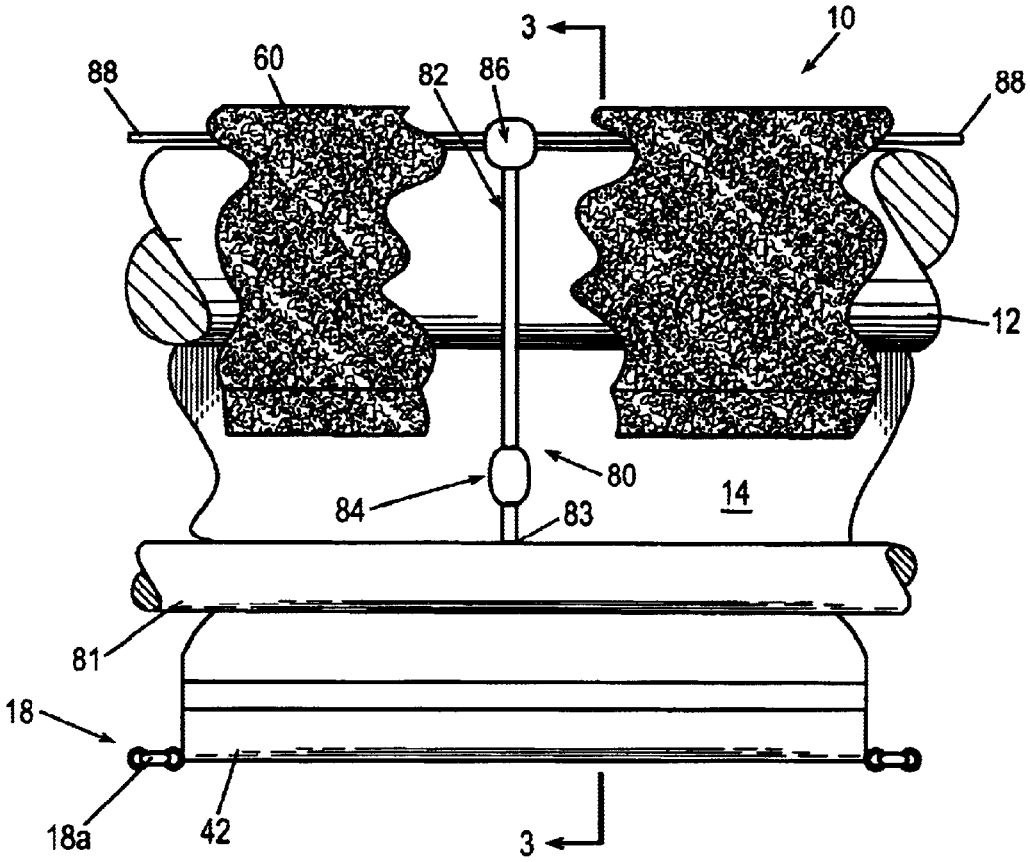
FIG. 2 is a side elevational view of a section of the embodiment of FIG. 1 with a portion of the fluid absorbing heat-resistant barrier cut-away to illustrate the means for distributing cooling fluid over the length of the boom and heat resistant barrier.

Referring now to the drawing, and in particular FIGS. 1–4, the preferred embodiment of the apparatus of the present invention is designated generally by the numeral 10. The preferred embodiment of the apparatus of the present invention 10 is a high temperature or heat-resistant oil containment boom (also known in the trade as a "fireproof boom") that is cooled by means 80 for distributing cooling fluid, preferably water, over the length of the boom and its protective fluid-absorbing cover 60. Boom 10 provides an elongated tube 12 formed of fluid impervious material, which may be divided into compartments (NOT SHOWN; see my prior applications U.S. Ser. No. 08/175,747 (now U.S. Pat. No. 5,374,133) and Ser. No. 08/851,124 filed May 5, 1997) along its length. Secured to the lower portion of tube 12, and extending along the length of tube 12, is skirt 14 which has connecting means (such as shown in my prior application U.S. Ser. No. 08/175,747 (now U.S. Pat. No. 5,374,133) to secure it to tube 12. Skirt 14 is a sheet formed of a fluid impervious material which is secured along its upper portion 39 to the lower portion of tube 12. Alternatively, tube 12 and skirt 14 can be integrally formed. The lower portion 40 of skirt 14 forms a compartment 42 which runs the length of tube 12 and has provided therein, as best seen in FIG. 1, weight or ballast means 18 for maintaining tension in skirt 14 when boom 10 is deployed and inflated as will be discussed further herein. Ballast 18, in the preferred embodiment, takes the form of a heavy chain 18*a*; however, in an alternate embodiment, it can take the form of particulate matter having a specific gravity substantially greater than that of water. (See, my prior application U.S. Ser. No. 08/175,747 (now U.S. Pat. No. 5,374,133)).

Tube 12 is filled by known means such as pressurized gas or foam to provide buoyancy. (See, my prior applications U.S. Ser. No. 08/175,747 (now U.S. Pat. No. 5,374,133) and Ser. No. 08/851,124 filed May 5, 1997, respectively).

Figure 3:
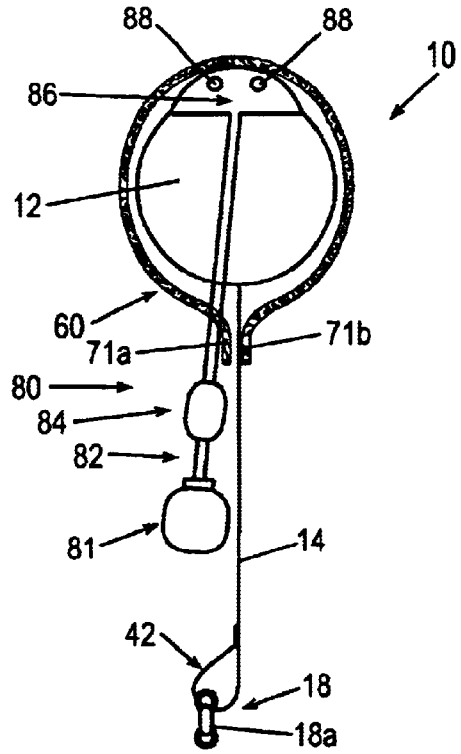
FIG. 3 is a cross-sectional end view of the embodiment of FIGS. 1 and 2 taken along LINES 3—3 of FIGS. 1 and 2.
Figure 4:
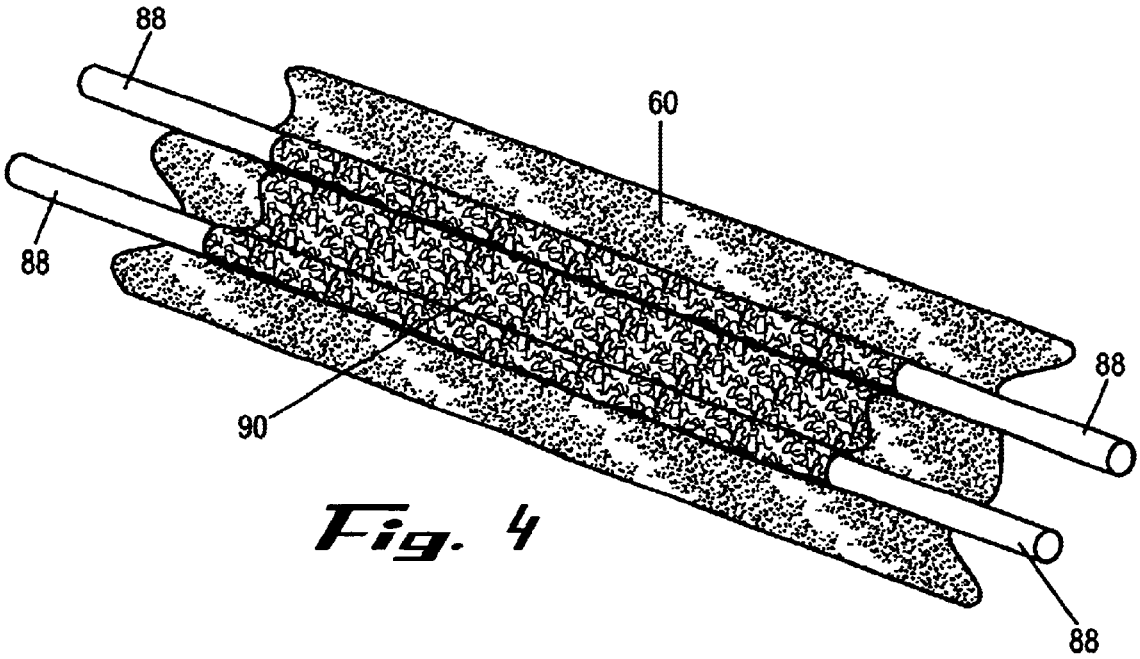
FIG. 4 is a perspective view, partially in section and partially cut-away, of the sleeve for the distribution lines of the means for distributing cooling fluid.

As best seen in FIGS. 1 and 3, boom 10 is provided with a protective cover or blanket 60. Cover 60 can be fabricated by assembling various layers as described in my prior application U.S. Ser. No. 08/175,747 (now U.S. Pat. No. 5,374,133). In the present invention blanket or cover 60 must have top and bottom layers of fabric that will absorb fluid, particularly water (one such absorbent fabric is cotton). Protective cover 60 can be fastened to skirt 14 of boom 10 as described in my prior application U.S. Ser. No. 08/175,747 (now U.S. Pat. No. 5,374,133).

As best seen in FIGS. 1 and 3, protective fluid-absorbing cover 60 is mounted on and secured to boom 10 by mounting it on tube 12 such that it rests upon the upper portion of tube 12 and so that longitudinal edges 71*a*, 71*b* substantially oppose each other on opposing sides of skirt 14. (As best seen in FIGS. 9 and 16 of my prior application U.S. Ser. No. 08/175,747 (now U.S. Pat. No. 5,374,133), a fire burning on the surface of body of water "W" having a water level "WL" will be resisted by cover 60, thereby protecting boom 10.)

As best seen in FIGS. 1–4, boom 10 is provided with means 80 for distributing cooling fluid, preferably water, over the length of boom 10 and, therefore, protective fluid-absorbing cover 60. A fluid supply line 81 connected to a source (NOT SHOWN) of cooling water (or other cooling fluid) under pressure extends the length of boom 10 at the mid-section of skirt 14. At some selected intermediate point (or points) 83 in supply line 81, a vertical riser (or risers) 82 directs the flow of the cooling fluid through an optional orifice 84 therein and into manifold 86 connected to the distal or upper end of riser 82. From manifold 86 the cooling fluid is directed into longitudinal distribution lines or sprinkler hoses 88 which have spaced-apart outlet ports 89 in the upper portion thereof to evenly distribute the cooling water over the length of tube 12 of boom 10 and therefore, protective fluid-absorbing blanket 60. Distribution lines 88 are encased in a sleeve or pocket 90, best seen in FIG. 4, which can be connected to the underside of blanket 60 so that as cooling fluid is distributed at spaced-apart ports 89 it evenly soaks blanket 60 from within and coats the upper surface of tube 12.

Figure 6:
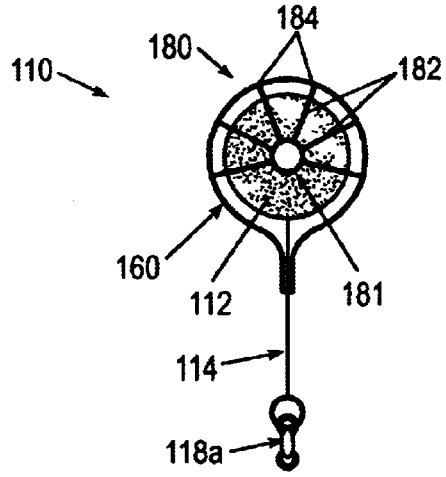
FIG. 6 is a cross-sectional end view of the embodiment of FIG. 5 taken along LINES 6—6 of FIG. 5.
Figure 5:
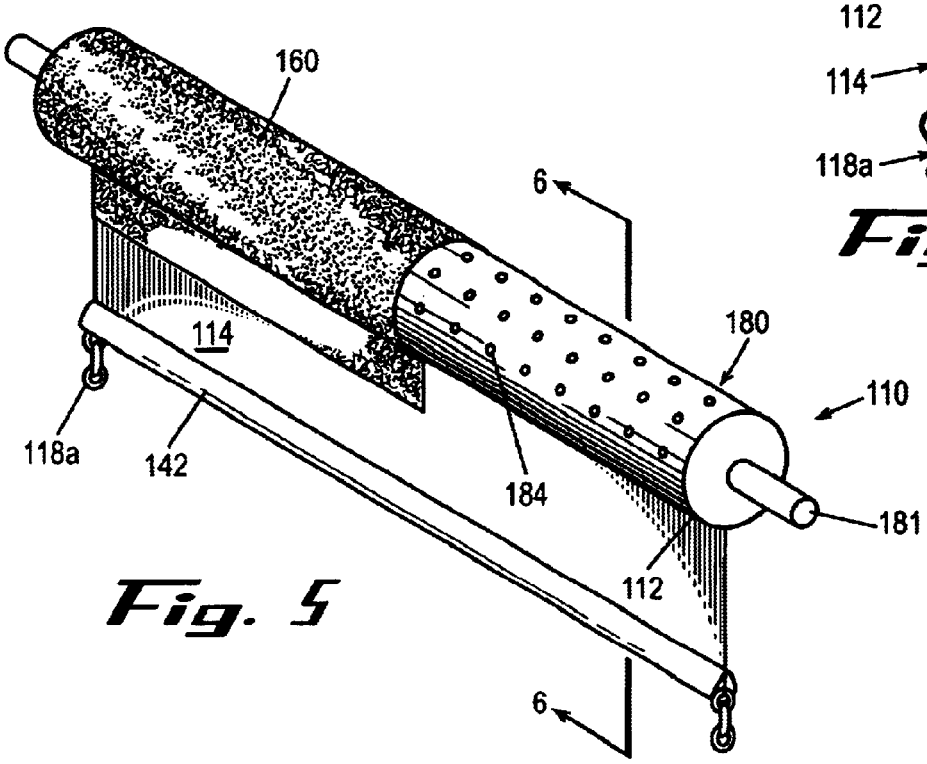
FIG. 5 is a perspective view, partially in section, of a first alternate embodiment of the apparatus of the present invention, with a portion of the fluid-absorbing heat resistant barrier cut-away to illustrate a portion of the means for distributing cooling fluid over the length of the boom and heat resistant barrier.

The first alternate embodiment 110, best seen in FIGS. 5 and 6 has skirt 114 and heavy chain 118*a* for ballast in compartment 142 just as preferred embodiment 10 does, but boom 110, differs from the preferred embodiment 10 in its water distribution means 180 which comprises a fluid supply line 181 extending longitudinally through sealed tube 112 (and any sealed compartments thereof, whether filled with air or foam). Supply line 181 has a plurality of spaced apart radially outwardly projecting distribution lines or sprinklers 182 which exit sealed tube 112 on its upper surface (below blanket 160) at outlet ports 184. When this embodiment 110 of the boom of the present invention is deployed into the water and the filling of tube 112 has been accomplished by applying pressurized air or inserting foam for buoyancy, water under pressure is supplied to the longitudinal supply line 181 and therefore, to each of the radial distribution lines 182, thus effecting distribution of the cooling water along the length of boom 110 and, therefore, blanket 160 so long as the fluid pressure is maintained in supply tube 181. With blanket 160 mounted over tube 112, there is created water distribution between not only ports 184 and tube 112, but blanket 160 and tube 112 as blanket 160 becomes soaked by absorbing the cooling water.

Figure 7:
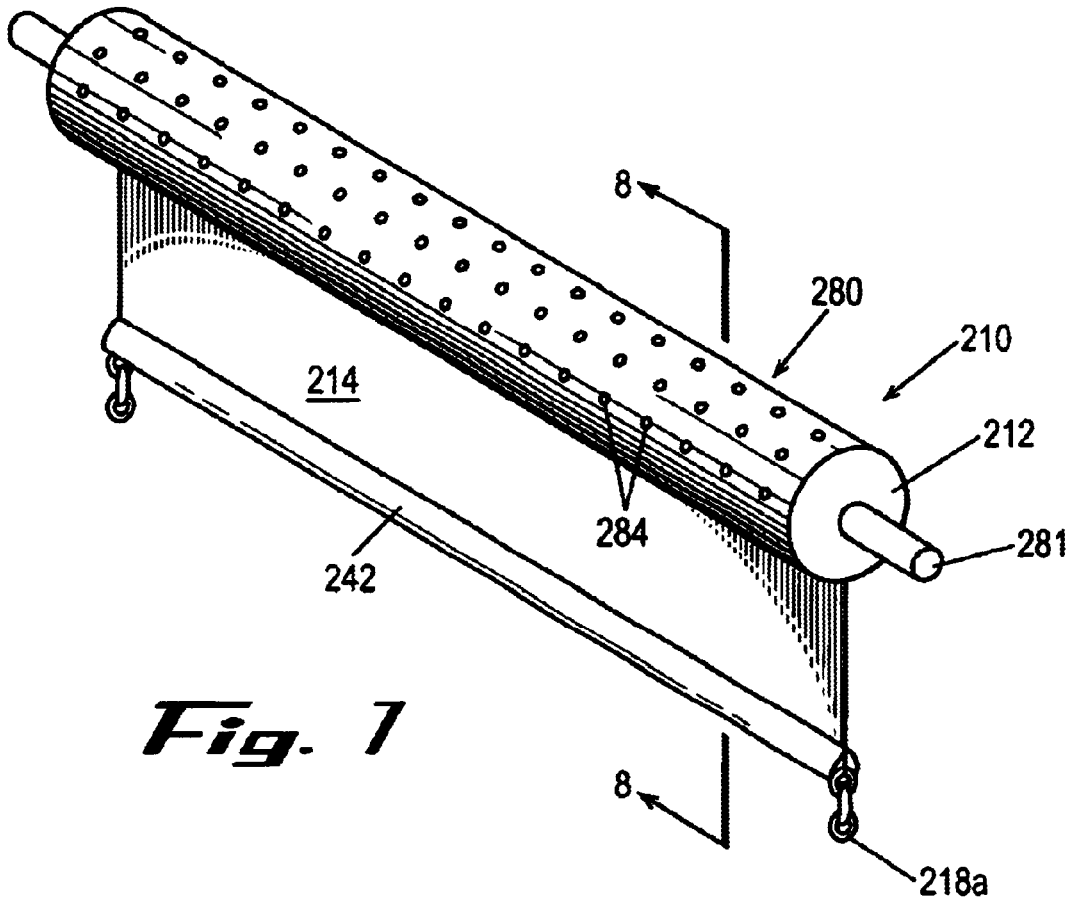
FIG. 7 is a perspective view, partially in section, of a second alternate embodiment of the apparatus of the present invention illustrating a portion of the means for distributing cooling fluid over the length of the boom; and, FIG. 8 is a cross-sectional end view of the embodiment of FIG. 7 taken along LINES 8—8 of FIG. 7.
Figure 8:
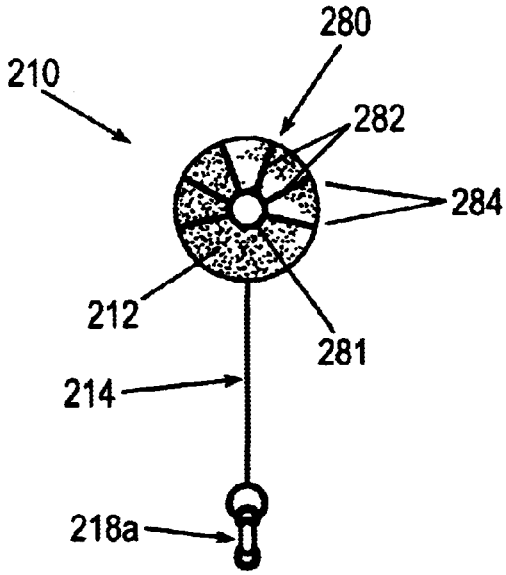

A second alternate embodiment 210, best seen in FIGS. 7 and 8 has skirt 214 and heavy chain 218*a* for ballast in compartment 242 and, is the same as the embodiment 110 of FIGS. 5 and 6, but without the protective fluid-absorbing cover or blanket 160. Here cooling water will be evenly distributed directly over tube 212 along its length by means 280 as the cooling water is supplied via line 281, through radial distribution lines 282 and exits at ports 284 to be sprayed over the upper surface of tube 212.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A float boom for confining material floatable on a liquid surface during high temperature conditions, comprising:

(a) an elongated floatable tube formed of fluid impervious material;

(b) a source of fluid under pressure for cooling said boom during high temperature conditions; and, (c) means connected to said source for distributing said cooling fluid over the length of said tube.

2. The boom of claim 1, further comprising:

(d) a protective cover mounted over said tube, said cover having peripheral edges adapted to engage said boom to substantially encase said tube therein.

3. The boom of claim 2, wherein said cover is of a material capable of absorbing said cooling fluid.

4. The boom of claim 3, wherein said distribution means comprises means for directing the flow of said cooling fluid to the upper surface of said tube between said tube and said protective cover.

5. The boom of claim 3, wherein said means for directing the flow of said cooling fluid comprises:

(i) a first conduit having proximate and distal ends, said proximate end connected to said source of cooling fluid; and, (ii) a second conduit connected to said first conduit and having spaced-apart apertures therealong for allowing said cooling fluid to flow onto the upper surface of said tube between said tube and said protective cover.

6. The boom of claim 2, wherein said distribution means comprises means for directing the flow of said cooling fluid to the upper surface of said tube between said tube and said protective cover.

7. The boom of claim 6, wherein said means for directing the flow of said cooling fluid comprises:

(i) a first conduit having proximate and distal ends, said proximate end connected to said source of cooling fluid; and, (ii) a second conduit connected to said first conduit and having spaced-apart apertures therealong for allowing said cooling fluid to flow onto the upper surface of said tube between said tube and said protective cover.

8. The boom of claim 1, wherein said distribution means comprises means for directing the flow of said cooling fluid to the upper surface of said tube.

9. The boom of claim 1, wherein said distribution means comprises:

(i) a first conduit having proximate and distal ends, said proximate end connected to said source of cooling fluid; and, (ii) a second conduit connected to said first conduit and having spaced-apart apertures therealong for allowing said cooling fluid to flow onto the upper surface of said tube.

10. A float boom for confining material floatable on a liquid surface during high temperature conditions, comprising:

(a) an elongated floatable tube formed of fluid impervious material;

(b) a source of fluid under pressure for cooling said boom during high temperature conditions;

(c) means connected to said source for distributing said cooling fluid over the length of said tube; and, (d) a protective cover mounted over said tube, said cover having peripheral edges adapted to engage said boom to substantially encase said tube therein.

11. The boom of claim 10, wherein said cover is of a material capable of absorbing said cooling fluid and thereby resisting high temperature.

12. The boom of claim 11, wherein said distribution means comprises:

(i) a first conduit having proximate and distal ends, said proximate end connected to said source of cooling fluid; and, (ii) a second conduit connected to said first conduit and having spaced-apart apertures therealong for allowing said cooling fluid to flow onto the upper surface of said tube.

13. The boom of claim 11, wherein said distribution means comprises means for directing the flow of said cooling fluid to the upper surface of said tube.

14. The boom of claim 10, wherein said distribution means comprises means for directing the flow of said cooling fluid to the upper surface of said tube.

15. The boom of claim 14, wherein said means for directing the flow of said cooling fluid comprises:

(i) a first conduit having proximate and distal ends, said proximate end connected to said source of cooling fluid; and, (ii) a plurality of second conduits each having proximate and distal ends, said second conduits being spaced apart and radially connected at their proximate ends to said first conduit therealong, and, having outlet ports at their distal ends for allowing said cooling fluid to flow onto the upper surface of said tube.

16. The boom of claim 15, wherein said first conduit extends longitudinally along said tube.

* * * * *